US006394005B1

(12) United States Patent
Isensee et al.

(10) Patent No.: US 6,394,005 B1
(45) Date of Patent: May 28, 2002

(54) ARTICULATING LOCKING MECHANISM

(75) Inventors: Loren L. Isensee, Chatfield; Joseph S. Bettin, Preston, both of MN (US)

(73) Assignee: Valley Design Enterprises, Inc., Fountain, MN (US)

( * ) Notice: Subject to any disclaimer, the term of this patent is extended or adjusted under 35 U.S.C. 154(b) by 0 days.

(21) Appl. No.: 09/627,887

(22) Filed: Jul. 28, 2000

(51) Int. Cl.[7] ..... A47B 3/00
(52) U.S. Cl. ..... 108/132
(58) Field of Search ..... 108/129, 130, 108/131, 132, 133; 248/188.6

(56) References Cited

U.S. PATENT DOCUMENTS

| | | | | |
|---|---|---|---|---|
| 613,298 | A | | 11/1898 | Palmtag |
| 963,439 | A | | 7/1910 | Hastings |
| 1,133,662 | A | | 3/1915 | Petrie |
| 1,203,783 | A | | 11/1916 | Reischmann |
| 2,459,529 | A | | 1/1949 | Jogwick et al. |
| 2,481,117 | A | | 9/1949 | Jogwick et al. |
| 2,514,061 | A | | 7/1950 | Hood |
| 2,653,066 | A | | 9/1953 | Anderson |
| 2,690,942 | A | | 10/1954 | Marcus |
| 3,554,141 | A | | 1/1971 | Burr |
| 3,695,567 | A | | 10/1972 | Weagle |
| 3,818,844 | A | | 6/1974 | Burr |
| 3,845,728 | A | | 11/1974 | Piretti |
| 4,064,815 | A | | 12/1977 | Baum |
| 4,139,175 | A | | 2/1979 | Bauer |
| 4,283,033 | A | | 8/1981 | Bauer |
| 4,373,334 | A | | 2/1983 | Carlander |
| 4,444,124 | A | | 4/1984 | Burr |
| 4,561,622 | A | | 12/1985 | Heinzel |
| 4,573,415 | A | * | 3/1986 | Ramey ..... 108/129 |
| 4,658,735 | A | | 4/1987 | Holton |
| 4,711,184 | A | | 12/1987 | Wallin et al. |
| 4,827,851 | A | | 5/1989 | Diffrient |
| 4,838,180 | A | | 6/1989 | Gutgsell |
| 4,838,181 | A | * | 6/1989 | Luyk ..... 108/131 X |
| 4,969,619 | A | | 11/1990 | Bauer et al. |
| 4,979,718 | A | | 12/1990 | Bauer et al. |
| 5,096,029 | A | | 3/1992 | Bauer et al. |
| 5,152,646 | A | | 10/1992 | Bauer |
| 5,188,345 | A | | 2/1993 | Siegner et al. |
| 5,273,259 | A | | 12/1993 | Bauer et al. |
| 5,323,713 | A | * | 6/1994 | Luyk et al. ..... 108/131 |
| 5,673,633 | A | | 10/1997 | Pfister |
| 5,845,589 | A | | 12/1998 | Pfister |
| 5,974,982 | A | * | 11/1999 | Lepper et al. ..... 108/131 X |

FOREIGN PATENT DOCUMENTS

| | | |
|---|---|---|
| CH | 446 642 | 3/1968 |
| EP | 0 176 955 | 9/1985 |

* cited by examiner

*Primary Examiner*—Jose V. Chen
(74) *Attorney, Agent, or Firm*—Kinney & Lange, P.A.

(57) ABSTRACT

An articulating locking mechanism for the locking and unlocking of a shaft member has a housing for mounting to any support surface, including an underside of a table. An operator pulls on a latch actuator to unlock the locking mechanism, thereby allowing a shaft member support to rotate within the housing between a first upright position and a second folded position. To lock the shaft member support into either position, the operator releases the latch actuator, whereby a finger on a latch member is urged by a spring into one of two grooves on the shaft member support, thereby locking the shaft member support into either its first upright position or its second folded position.

17 Claims, 5 Drawing Sheets

36
2
62
56
56
70
38
80
26
58
22
32
33
14
45
16
22
20
22
18
13
10
12

5
5
10
12
14
16
18
22
24
28
32
33
34
38
39
40
42
43
44
45
46
47
48
52
54
56
60
68
72
72a
72b
74
76
77
80
13

10
34
39
80
16
38
33
32
14
24
40
52
44
28
43
18
22
22
13
54
72
76

ARTICULATING LOCKING MECHANISM

BACKGROUND OF THE INVENTION

The present invention relates to a locking mechanism for securing an articulating shaft member to a surface. In particular, the present invention relates to a locking mechanism for mounting to the underside of a table to lock a table leg in either an extended position or folded position. Preferably, there are at least two table legs attached to a table by the inventive locking mechanisms.

Various prior art locking mechanisms have been applied to the underside of tables to hold table legs in upright or folded positions. For example, Pfister U.S. Pat. No. 5,845,589 and Pfister U.S. Pat. No. 5,673,633 both disclose folding table leg systems for locking and unlocking a table leg in a upright or folded position. In each patent a biased lever controls the locking and unlocking of the table leg. In the Pfister patents, the operator pushes on the lever, releasing a latch member from a locked groove to allow manipulation of the table leg. The push lever system of the prior art creates the possibility for an accidental pushing of the operative lever by a knee or leg, thereby causing the table leg to be released from its locked upright position and become folded. In addition, the Paster patent designs are complex, requiring many parts and components.

BRIEF SUMMARY OF THE INVENTION

The present invention is adaptable for mounting to any surface and for locking any member in a upright or folded position relative to that surface. The present invention is a locking device for articulately mounting a shaft member to a support surface. In a preferred embodiment, the support surface is the underside of a table and the shaft member is a table leg. The locking device comprises a housing for mounting to the support surface, with the housing having a cavity therein, and the cavity having an opening therein. A shaft member support is rotatably mounted within the cavity between a first upright position and a second folded position. The shaft member support has a corresponding first lock groove to lock the shaft member support in the first upright position and a second lock grooves to lock the shaft member support in the second folded position. A latch member, located between the support surface and the shaft member support, is rotatably mounted within the housing cavity. The latch member has a finger thereon to selectively project into either the first or second lock groove of the shaft member support to define the position of the shaft member support relative to the housing.

In a preferred embodiment, the locking and unlocking of the shaft member support is controlled by a latch actuator located on the housing. When the latch actuator is pulled, the pulling motion translates movement over a cable to pull the latch member against a spring force away from the shaft member support, thereby removing the finger from a lock groove. With the latch actuator pulled and the finger removed from a lock groove, the shaft member support is free to rotate between its first upright and second folded positions. Once the shaft member support is in either its first upright position or its second folded position, the latch actuator is released allowing the spring force to urge the latch member toward the shaft member support. The movement of the latch member toward the shaft member support selectively inserts the finger on the latch member into either the first grove or the second lock groove, thereby locking the shaft member support in position relative to the housing.

BRIEF DESCRIPTION OF THE DRAWINGS

The present invention will be further explained with reference to the attached figures, wherein like structure is referred to by like numerals throughout the several views.

While the above-identified drawing figures set forth one preferred embodiment of the invention, other embodiments are also contemplated, as noted in the discussion. In all cases, this disclosure presents the present invention by way of representation and not limitation. It should be understood that numerous other modifications and embodiments can be devised by those skilled in the art which fall within the scope and spirit of the principles of this invention.

DETAILED DESCRIPTION

Figure 1:
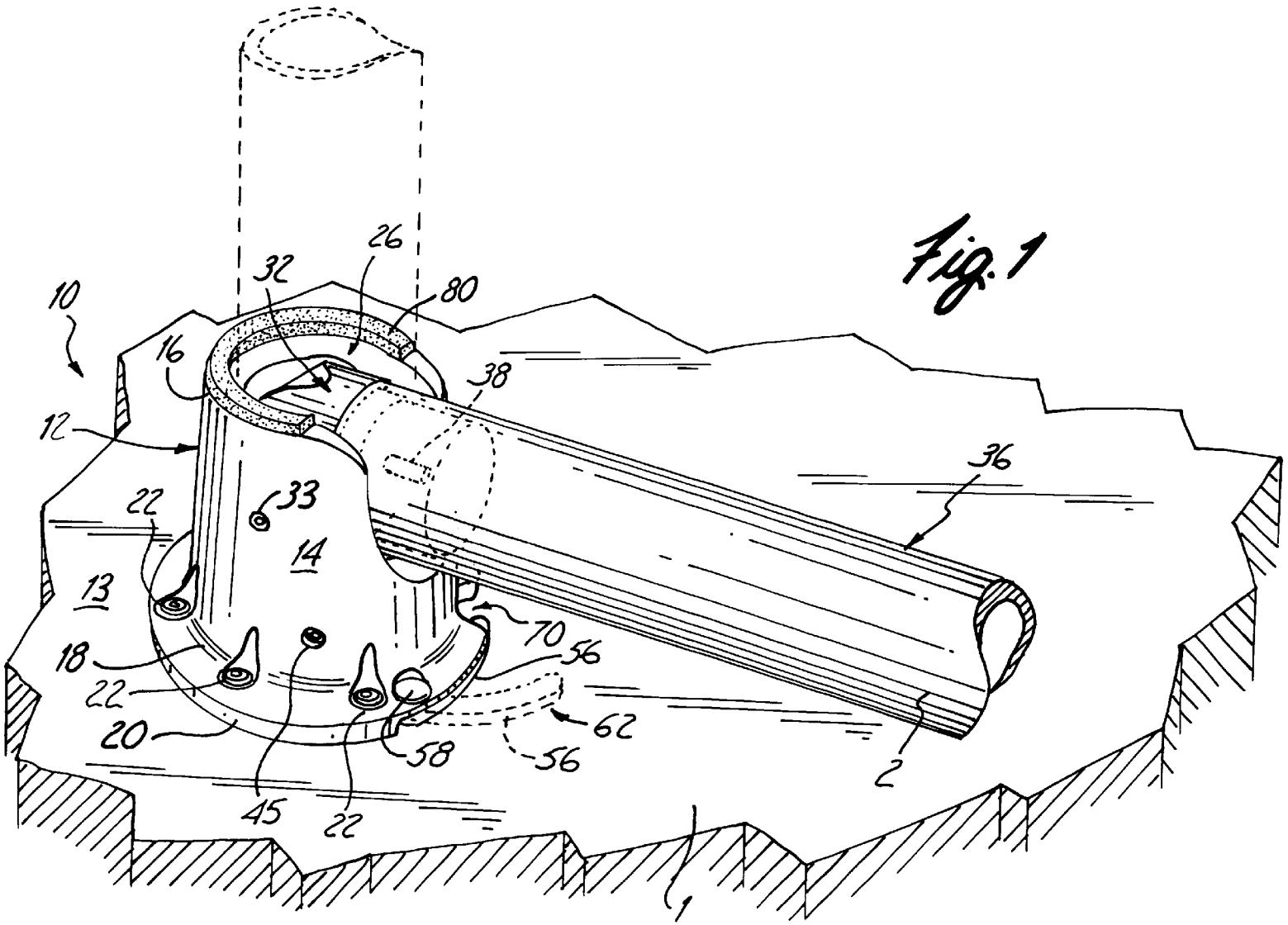
FIG. 1 is a perspective view of the articulating locking mechanism of the present invention.

The present invention, as seen in FIG. 1, is a locking mechanism 10 for articulatably mounting a shaft member 2 to a support surface 1. The locking mechanism 10 is affixed to the support surface 1, which in one case is the underside of a table. The locking mechanism 10 locks the shaft member 2 in an upright position (shown in FIG. 1 in dashed lines) allowing the table to stand and support a load. The locking mechanism 10 can be manipulated to allow the shaft member 2 to rotate from its upright position to a folded position (shown in FIG. 1 in solid lines). The locking mechanism 10 can then be locked again to secure the shaft member 2 in the folded position. The locking and unlocking of the locking mechanism 10 is accomplished by the operator pulling on a lever. The lever is preferably recessed and designed so that only an operator's finger can pull on the lever. By pulling on the lever (versus pushing on a lever, as in the prior art), the locking mechanism 10 prevents the accidental unlocking by a knee or foot. The locking mechanism also offers a more elegant design than the prior art. Fewer parts and fewer moving components results in fewer potential mechanical problems, fewer parts and less labor for fabrication and assembly (and hence, less expense).

The locking mechanism 10 has a housing 12 for mounting to any desired support surface, such as the underside 13 of a table. The housing 12 can be any shape suitable for mounting to the support surface 13. Preferably, the housing 12 is generally circular in cross-section along a plane parallel to the support surface 13, as defined by side wall 14 which extends upward from the support surface 13 to an outer face 16 which is spaced from the support surface. The housing 12 has a flared base 18 formed by an annular ring 20. The flared base 18 of the housing 12 has a flat bottom but can be in any form for attachment to a variety of support surface shapes. Around the circumference of the annular ring 20 are a plurality of fastener holes 22 that enable the housing 12 to be mounted to a surface using suitable fasteners (e.g., screws). The housing 12 has a cavity 24 therein with an upper opening 26 and a lower opening 28. Preferably, the cavity 24 is generally circular in cross-section along a plane parallel to the support surface 13. As can be seen in FIG. 1, the upper opening 26 into the cavity 24 extends from the outer face 16 of the housing 12 into a portion of the side wall 14 of the housing 12. The lower opening 28 to the cavity 24 may extend in part to a bottom 30 of the housing, as seen in FIG. 5.

Figure 2:
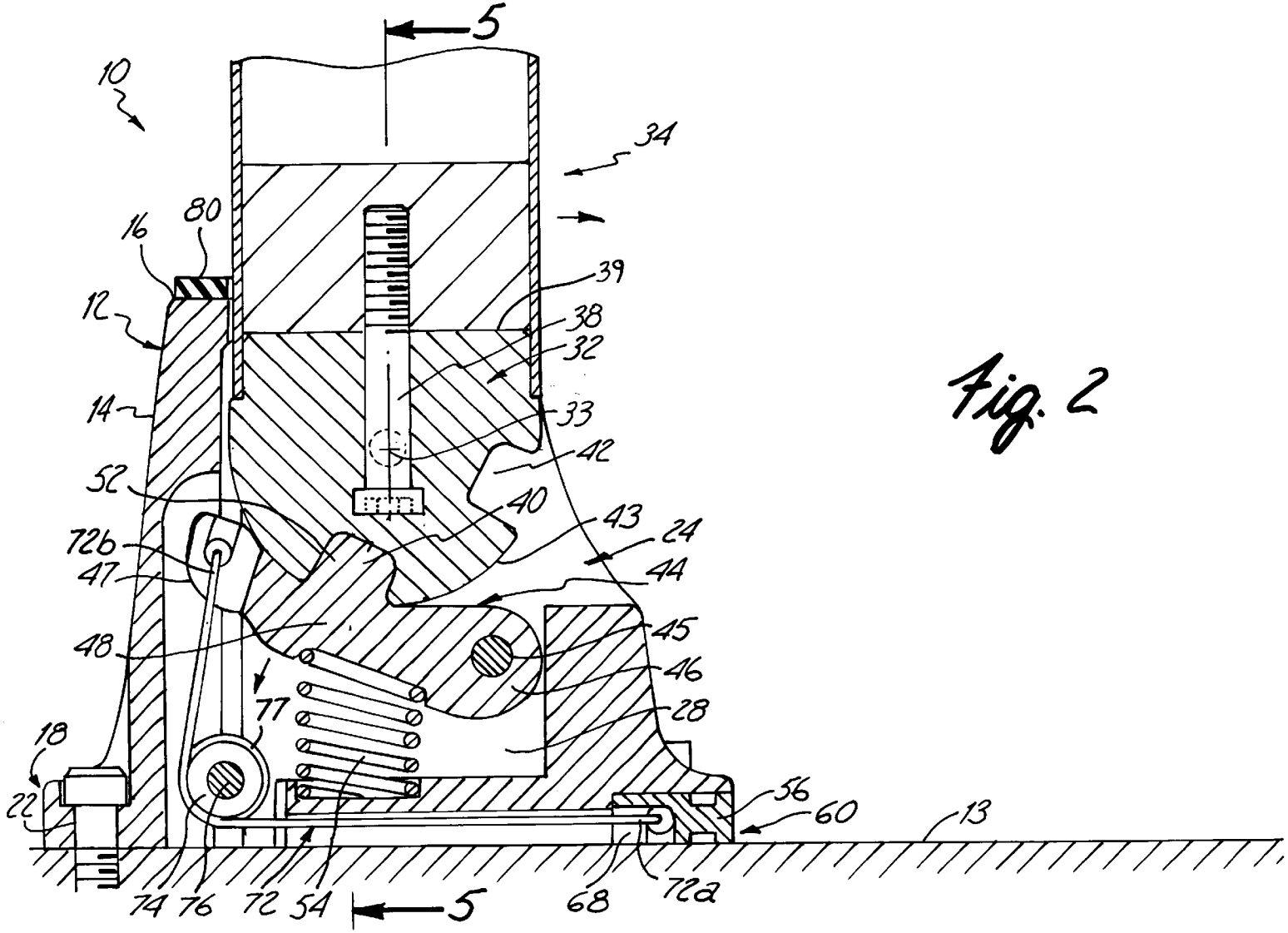
FIG. 2 is a central sectional view of the inventive mechanism in its first upright position.
Figure 3:
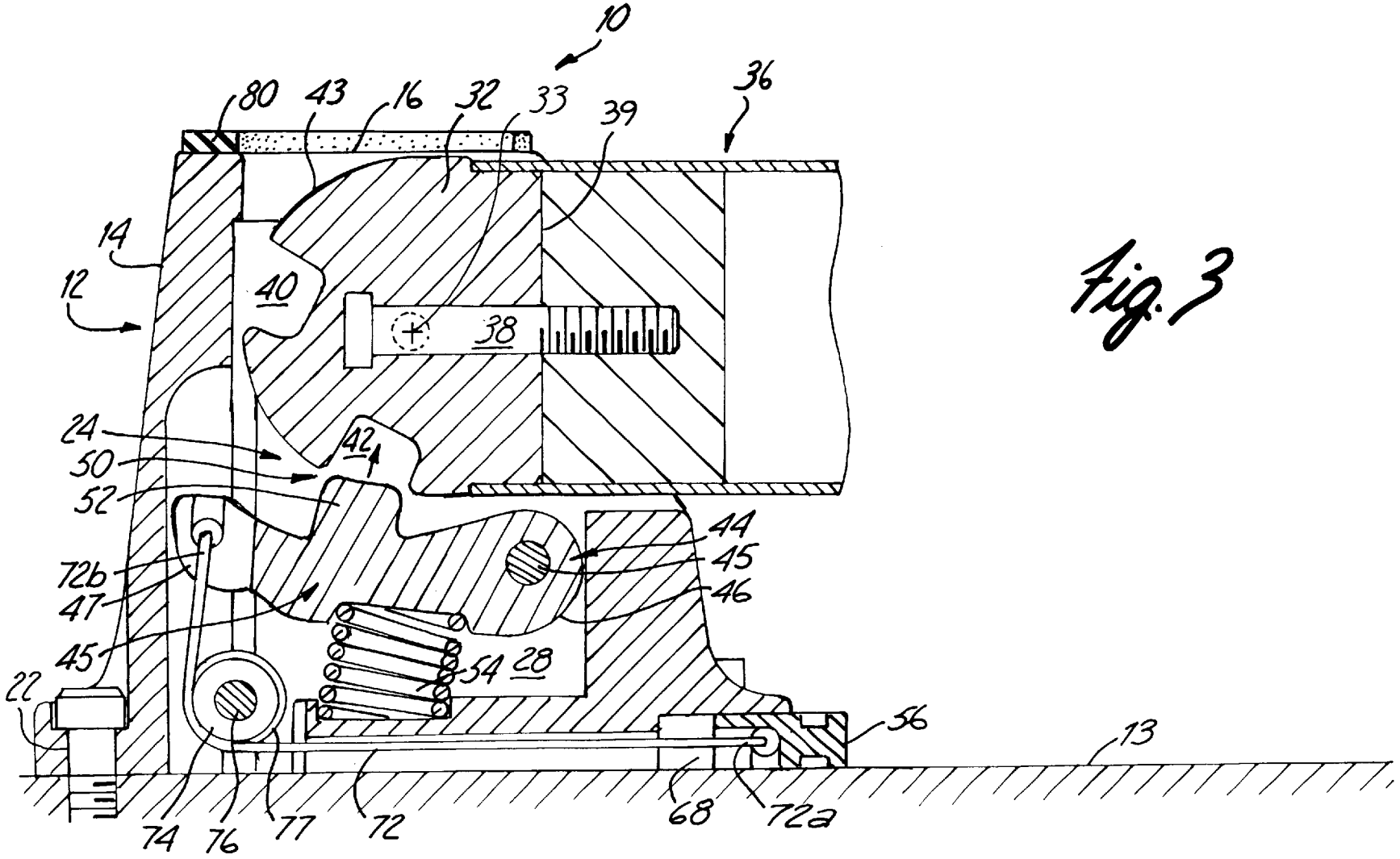
FIG. 3 is a central sectional view of the inventive mechanism in its second folded position.
Figure 5:
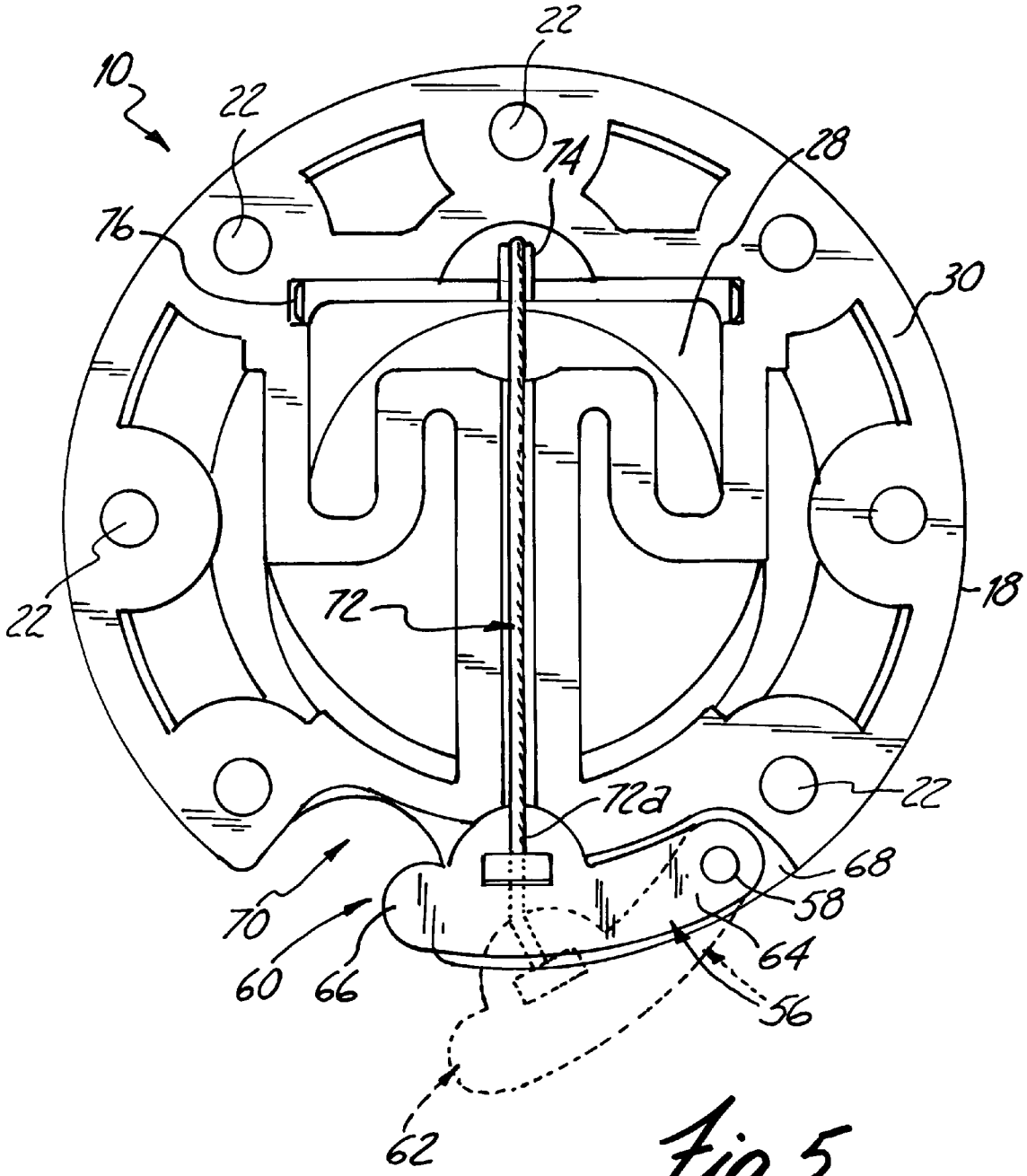
FIG. 5 is a bottom view of the inventive mechanism.

A shaft member support 32 is rotatably mounted on a first axis 33 within the cavity 24 for movement between a first upright position 34 (as seen in FIGS. 2 and 5, and in dashed lines in FIG. 1) and a second folded position 36 (as seen in FIGS. 1 and 3). The shaft member support 32 is generally circular in cross-section along a plane parallel to the support surface 13 and has a shaft member support surface 39 for mounting the shaft member 2 thereto. In one embodiment, the shaft member support 32 has a bore into the shaft member support surface 39 for reception of a head bolt 38 or the like. In another embodiment (as shown), the head bolt 38 or its equivalent is integrally molded into the shaft member support 32. The shaft member support 32 has a first lock groove 40 and a second lock groove 42 arcuately spaced apart about the first axis 33, and which are aligned generally parallel to the first axis 33. As shown in FIG. 2, the shaft member support surface 39 is aligned opposite the first lock groove 40. As seen in FIGS. 2 and 3, the shaft member support 32 has in part a spherical outer surface 43 with the first and second lock grooves 40 and 42 defined thereon.

A latch member 44 is rotatably mounted on a second axis 45 (parallel to the first axis 33) within the cavity 24 of the housing 12 adjacent the lower opening 28. The latch member 44 has a first end 46, a second end 47, and a central portion 48 therebetween. The latch member 44 is pivotally mounted to the housing 12 adjacent its first end 46, and has a finger 52 formed on an upper side thereof (as viewed in FIG. 3) adjacent its central portion 48. The latch member 44 is pivotally mounted for movement between a shaft member support engaged position 49 (FIGS. 2 and 4) and a shaft member support disengaged position 50 (FIG. 3). The finger 52 (or its equivalent) is formed to selectively project into the first lock groove 40 or the second lock groove 42. The finger 52 projects into the first lock groove 40 when the latch member 44 is in its engaged position 49 and the shaft member support 32 is in its first upright position 34 (FIG. 2). The finger 52 projects into the second lock groove 42 when the latch member 44 in its disengaged position 50 and the shaft member support 32 is in its second folded position 36 (FIG. 1).

A spring 54 mounted in the housing 12 adjacent the lower opening 28 of the cavity 24 urges the finger 52 of the latch member 44 toward the shaft member support 32. The spring 54 contacts a bottom side of the latch member 44 adjacent the central position 48, generally opposite the finger 52. The spring 54, as shown in FIGS. 2, 3 and 5, is a coil spring, although any suitable biasing means or material will suffice.

A latch actuator 56 is pivotally mounted on a third axis 58 to the housing 12 to pivot between a retracted lock position 60 (FIG. 5 solid lines) and an extended release position 62 (FIG. 5 dashed lines). As seen in FIG. 1, the latch actuator 56 is mounted on the flared base 18 on the third axis 58 (which is preferably aligned perpendicular to the first axis 33). The latch actuator 56 has a pivot end 64 and a free end 66. A recess 68 is formed in the flared base 18 for reception of the latch actuator 56 in its retracted lock position 60. The recess 68 has a finger insert opening 70 adjacent the free end 66 of the latch actuator 56 to enable an operator to pull the free end 66 of the latch actuator 56 from its retracted lock position 60 to its extended release position 62 (thereby pivoting the latch actuator 56 about the third axis 58).

Figure 4:
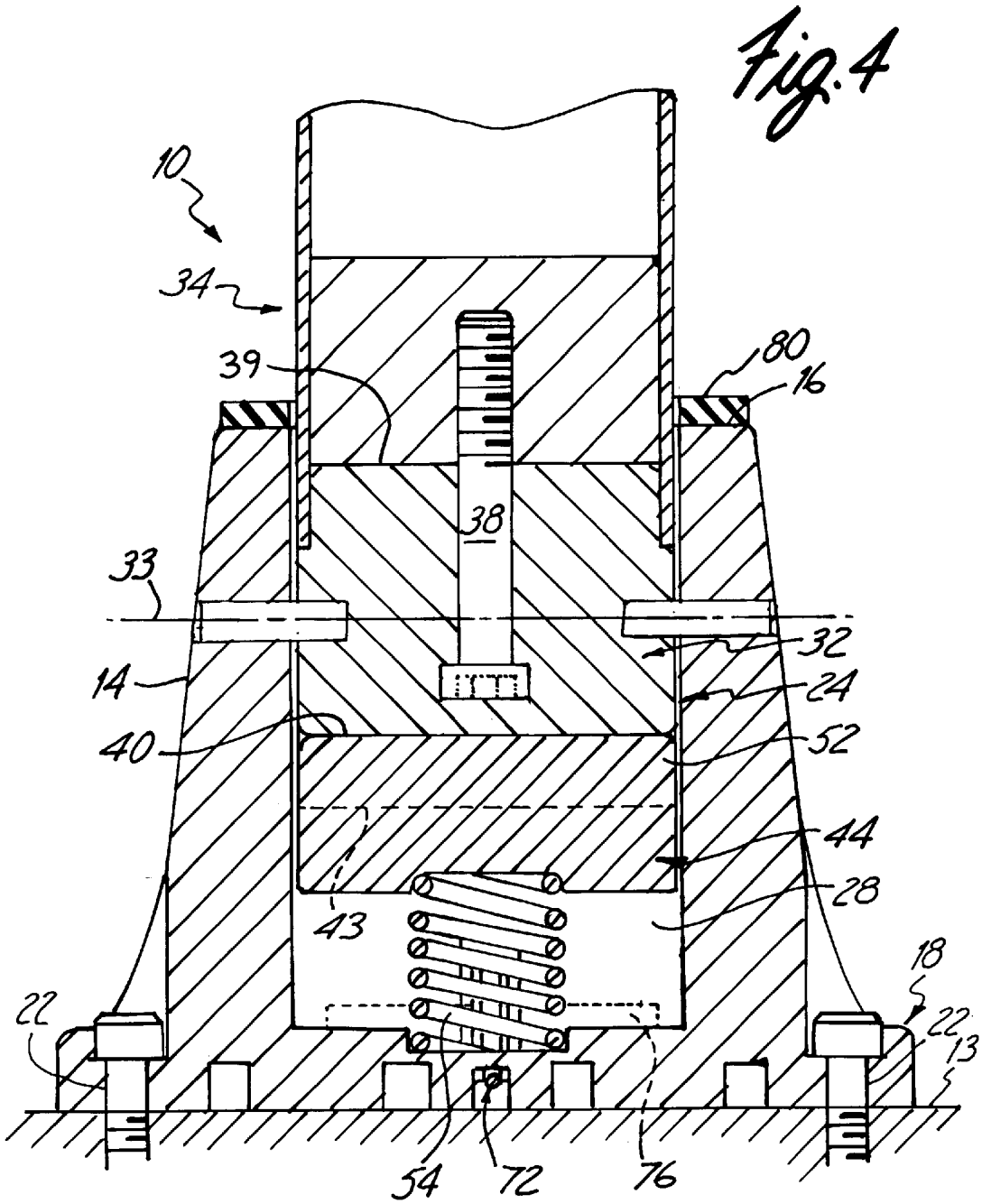
FIG. 4 is a sectional view as taken along lines 4—4 of FIG. 2.

A connecting cable 72 is attached at one end 72*a* to the latch actuator 56 (FIG. 5) and at its other end 72*b* to the second end 47 of the latch member 44 FIGS. 2 and 3). Via this connection of the latch actuator 56 and the latch member 44, the cable 72 facilitates coupled movement of the latch actuator 56 and the latch member 44. An arcuate cable guide aids in translating movement of the latch actuator 56 about the third axis 58 into movement of the latch member 44 about the second axis 45. In a preferred embodiment, the arcuate cable guide is a wheel 74 rotatably mounted on a fourth axis 76 parallel to the first axis 33. As seen in FIGS. 2–4, the wheel 74 is pivotally mounted adjacent the lower opening 28 of the cavity 24. To further facilitate the movement of the cable 72 around the circumference of the wheel 74, the wheel 74 has a circumferential groove 77 thereon to keep the cable 72 from falling off of the wheel 74. Thus, the cable 72 runs vertically from the second end 47 of the latch member 44, over the arcuate cable guide (wheel 74), and then horizontally along the bottom 30 of the housing 12 to a point on the latch actuator 56 adjacent its free end 66. The cable 72 facilitates translation of movement about a vertical axis into movement about a horizontal axis. Although a cable 72 is shown, any suitable generally inextensible coupling between the operable members (latch actuator 56 and latch member 44) will suffice.

As seen in FIG. 2, when the locking device 10 is in its first upright position 34, the latch member finger 52 is in its engaged position 48 with the latch member finger 52 projecting into the first lock groove 40 on the shaft member support 32, and the latch actuator 56 is in its retracted locked position 60. To disengage the shaft member support 32 from its first upright position 34, the operator pivots the latch actuator 56 from its retracted lock position 60 to its extended release position 62 (about third axis 58). As the latch actuator 56 moves from its retracted locked position 60 to its extended release position 62, that movement is translated over the cable 72 thereby pivoting the latch member 44 on the second axis 45 from its shaft member support engaged position 49 to its shaft member support disengaged position 50. Pulling the latch actuator 56 to its extended release position 62 forces the latch member 44 against the bias force of the spring 54, compressing the spring 54. At the same time, the latch member 44 moves from the shaft member support engaged position 49 to its shaft member support disengaged position 50, and thus removes the finger 52 from the first lock groove 40 of the shaft member support 32. At this point, the shaft member support 32 is free to rotate on the first axis 33 within the cavity 24 of the housing 12. The operator then articulates the shaft member support 32 from its first upright position 34 (FIG. 2) to its second folded position 36 (FIGS. 1 and 3). Once the shaft member support 32 is in the second folded position 36, the operator then releases the latch actuator 56. Once released, the latch actuator 56 moves from its extended release position 62 to its retracted locked position 60. The movement of the latch actuator 56 from its extended release position 62 to its retracted locked position 60 is caused by the release of the compressed force of the spring 54, which urges the latch member 44 towards the shaft member support 32. Without the force supplied by the operator to hold the latch actuator 56 in the extended release position 62, the force of the spring 54 moves the latch member 44 towards the shaft member support 32 which pulls on the cable 72 to move the latch actuator 56 to its retracted lock position 60. As the latch actuator 56 moves from its extended release position 62 to its retracted locked position 60, the spring 54 also forces the latch member 44 to move from its disengaged position 50 to its engaged position 49. In the shaft member support engaged position 49, the finger 52 projects into the second lock groove 42 of the shaft member support 32 to lock the shaft member support 32 in place relative to the housing 12.

When all of the legs of a table are folded down in this manner, the table has a low profile. Often, such tables will be stacked for storage. In a preferred embodiment of the present invention, the outer surface 16 of the housing 12 has a layer of resilient material 80 thereon. The layer of resilient material 80 extends farther from the support surface 13 than any other portion of the housing 12 or shaft 2 (table leg) so that it engages the top surface of another table when the tables are stacked. The layer of resilient material 80 thus engages a tabletop to prevent marring or scratching of that surface. The generally cylindrical shape of the housing 12 serves to protect the inner working components of the inventive locking mechanism 10 from damage or inadvertent manipulation. The housing 12 has a slight tapered structure and is formed with generally curved and rounded surfaces on its exterior, giving it a pleasing appearance. This exterior form also minimizes sharp edges which might catch on a leg of a user of the table or an article of clothing, and further serves to deflect other harder articles away from the operative components of the locking mechanism 10 to protect them from harm.

To rotate the shaft member support 32 from its second folded position 36 back to its first upright position 34, the latch actuator 56 is again pulled from its retracted locked position 60 to its extended release position 62. Once again, this movement of the latch actuator 56 causes the latch member 44 to move against the bias force of the spring 54, thereby compressing the spring 54 while pivoting the latch member 44 about the second axis 45 from its engaged position 44 to its disengaged position 50. In the disengaged position 50, the finger 52 is removed from the second lock groove 42 and the shaft member support 32 is free to pivot about the first axis 33 from its second folded position 36 to its first upright position 34. Once the shaft member support 32 is in the first upright position 34, the latch actuator 56 is again released, whereby the latch actuator 56 moves from its extended release position 62 to its retracted locked position 60. The release of the latch actuator 56 allows the compressed spring 54 to urge the latch member 44 toward the shaft member support 32. The resultant movement of the latch member 44 towards the shaft member support 32 pulls the cable 72 attached to the latch actuator 56 thereby moving the latch actuator 56 from its extended release position 62 to its retracted lock position 60. The force of the spring 54 causes the latch member 44 to rotate about the second axis 45 from its disengaged position 50 to its engaged position 49, thereby projecting the finger 52 into the first lock groove 40. Once the latch member finger 52 is in the first lock groove 40 the shaft member support 32 is locked in its first upright position 34 relative to the housing 12.

In the illustrated table leg support embodiment, the first, second and fourth axes are shown as horizontal, while the third axis is shown as vertical. The inventive locking mechanism has other contemplated applications, such as the relative mounting of other articulating components like, for example, a flag pole on a wall or a folding pole, beam or strut on a boat, ship, or vehicle. Thus, while the illustrated orientation may be preferred, it is not exclusive. Likewise, while the third axis is shown and described as perpendicular to the first axis, it may take any desired orientation necessary to facilitate operation of the latch actuator, depending on the position of the latch actuator relative to the housing.

Although the present invention has been described with reference to preferred embodiments, workers skilled in the art will recognize that changes may be made in form and detail without departing from the spirit and scope of the invention.

What is claimed is:

1. A locking device for articulatably mounting a shaft member to a support surface, the locking device comprising:

a housing mounted to the support surface, the housing having a cavity therein, the cavity having an upper opening and a lower opening;

a shaft member support rotatably mounted on a first axis within the cavity of the housing for movement between a first upright position and a second folded position, the shaft member support having first and second lock grooves thereon, with the lock grooves arcuately spaced apart about the first axis;

a latch member rotatably mounted on a second axis parallel to the first axis within the cavity of the housing adjacent the lower opening thereof for movement between a shaft member support engaged position and a shaft member support disengaged position, the latch member having a finger thereon formed to selectively project into the first lock groove on the shaft member support when the latch member is in its engaged position and the shaft member support is in its first upright position, and into the second lock groove on the shaft member support when the latch member is in its disengaged position and the shaft member support is in its second folded position.

2. The locking device of claim 1 wherein the shaft member support has a shaft member support surface aligned opposite the first lock groove thereon.

3. The locking device of claim 1 and further comprising:

a spring mounted in the housing adjacent the lower opening of the cavity for urging the finger of the latch member toward the shaft support;

a latch actuator pivotally mounted on a third axis to the housing for movement between a retracted lock position and an extended release position;

a recess formed on the housing for reception of the latch actuator when in its retracted lock position; and a cable connecting the latch actuator to the latch member whereby movement of the latch actuator to its extended release position pulls the latch member, via the cable therebetween, against the urging of the spring to pivot the finger on the latch member out of one of the lock grooves on the shaft member support thereby allowing movement of the shaft member support relative to the housing.

4. The locking device of claim 3 wherein the latch member has a first end, a second end, and a central portion therebetween, and wherein the latch member is pivotally mounted to the housing adjacent its first end, connected to the cable adjacent its second end and, has the finger formed thereon adjacent its central portion.

5. The locking device of claim 4 wherein the spring contacts the latch member adjacent the central portion thereof.

6. The locking device of claim 3 wherein the spring is a coil spring.

7. The locking device of claim 3 wherein the third axis is perpendicular to the first axis.

8. The locking device of claim 3 and further comprising:

an arcuate cable guide to aid in translating movement of the actuator about the third axis into movement of the latch member about the second axis.

9. The locking device of claim 8 wherein the cable guide comprises:

a wheel rotatably mounted to the housing on a fourth axis which is parallel to the first axis.

10. The locking device of claim 3 wherein the recess has a finger insert opening adjacent a free end of the latch actuator.

11. The locking device of claim 3 wherein the recess on the housing is adjacent the support surface.

12. The locking device of claim 1 wherein the shaft member support has in part a spherical outer surface with the first and second grooves defined thereon.

13. The locking device of claim 1 wherein the housing is generally circular in cross-section along a plane parallel to the support surface.

14. The locking device of claim 1 wherein the shaft member support is generally circular in cross-section along a plane parallel to the support surface.

15. The locking device of claim 1 wherein the cavity is generally circular in cross-section along a plane parallel to the support surface.

16. The locking device of claim 1 wherein, in use, the first axis is a horizontal axis.

17. The locking device of claim 1, wherein the housing has an outer face thereon spaced from the support surface, and further comprising:

a layer of resilient material mounted on the outer face of the housing.

* * * * *